US006474442B1

(12) United States Patent
Atkinson et al.

(10) Patent No.: US 6,474,442 B1
(45) Date of Patent: Nov. 5, 2002

(54) SAFETY DEVICE

(75) Inventors: Geoffrey Fraser Atkinson, Chippenham; Jonathan Michael Cogzell, Swindon, both of (GB)

(73) Assignee: Latchways PLC., Wiltshire (GB)

( * ) Notice: Subject to any disclaimer, the term of this patent is extended or adjusted under 35 U.S.C. 154(b) by 0 days.

(21) Appl. No.: 09/719,761

(22) PCT Filed: Jun. 18, 1999

(86) PCT No.: PCT/GB99/01882

§ 371 (c)(1),
(2), (4) Date: Mar. 9, 2001

(87) PCT Pub. No.: WO99/65572

PCT Pub. Date: Dec. 23, 1999

(30) Foreign Application Priority Data

Jun. 19, 1998 (GB) ..... 9813351

(51) Int. Cl.[7] ..... E04G 3/14; B61B 7/00
(52) U.S. Cl. ..... 182/36; 182/3; 104/115
(58) Field of Search ..... 182/36, 3; 248/237; 104/115

(56) References Cited

U.S. PATENT DOCUMENTS

| | | | | |
|---|---|---|---|---|
| 2,172,094 A | * | 9/1939 | Voigt | 182/3 X |
| 3,179,994 A | * | 4/1965 | Meyer et al. | 182/3 X |
| 3,317,971 A | | 5/1967 | Meyer | |
| 3,348,632 A | * | 10/1967 | Swager | 182/3 X |
| 3,703,218 A | * | 11/1972 | Brda | 182/36 X |
| 3,933,220 A | * | 1/1976 | Swager | 182/3 |
| 4,607,724 A | * | 8/1986 | Hillberg | 182/3 |
| 4,790,410 A | * | 12/1988 | Sharp et al. | 182/36 |
| 5,224,427 A | * | 7/1993 | Riches et al. | 182/3 X |
| 5,265,696 A | | 11/1993 | Casebolt | |
| 5,279,385 A | * | 1/1994 | Riches et al. | 182/3 |
| 5,343,975 A | | 9/1994 | Riches et al. | |

FOREIGN PATENT DOCUMENTS

| | | |
|---|---|---|
| EP | 0608164 A1 | 7/1994 |
| FR | 952476 | 11/1949 |
| FR | 2525906 | 11/1983 |

* cited by examiner

*Primary Examiner*—Daniel P. Stodola
*Assistant Examiner*—Hugh B. Thompson
(74) *Attorney, Agent, or Firm*—Tarolli, Sundheim, Covell, Tummino & Szabo L.L.P.

(57) ABSTRACT

A personal safety device (10) adapted for longitudinal movement relative to an elongate support element (50) comprises a body (11) having a bore (12) for receiving the element (50), a slipper (20) mounted on the body (11) the slipper (20) having a surface (21) oriented substantially parallel to the longitudinal axis of said bore (12), and connector (30) connected to the slipper (20) and being adapted at its other end (31) for connection to a personal safety harness. Slipper (20) is movable between first and second positions in response to sudden loading of the connector (30). In the first position, surface (21) allows free passage element (50) through the bore (12). When slipper (20) is in the second position, surface (21) clamps element (50) firmly to body (11).

7 Claims, 3 Drawing Sheets

SAFETY DEVICE

The present invention relates to a safety device and, in particular, to a versatile personnel safety device for reducing the risk of injury to personnel engaged in work in elevated or vulnerable positions, such as high buildings or the deck of a boat or ship.

Personnel safety appliances, such as vertical fall arrest devices, are an important accessory for personnel working in situations where a fall is potentially life-threatening, since they enable the hazard of a fall to be minimised. Vertical fall arrest systems are known which employ a safety line such as a flexible cable for engagement, in a fall arrest situation, by a fall arrest device. Such systems require intermediate support brackets to restrain the cable from buffeting against the fixed structure while under wind loading. These systems therefore present a practical problem of enabling the fall arrest device (and the user) to bypass the support brackets without increasing the fall hazard.

Certain known designs attempt to overcome this bypass problem by using a manually operated bracket lock. This requires the user to open and close the bracket when he traverses it. Other known designs require that the user should lean out from the normal climb/descend posture and pull the cable away from the bracket in order to move the fall arrest device past the bracket position. Both of these methods add significantly to the difficulty of the climb, are more tiring and hence possibly increase the fall hazard.

Some very tall structures, such as telecommunication pylons, masts etc., have a number of separate spans of elongate safety element around the structure. This is due to the fact that ladder placement is often along a number of different climbing axes. Such structures may therefore require the detachment and re-attachment of the safety device at any point during the climb or descent, and the ease with which this can be achieved is an important factor in determining the overall safety of the manoeuvre.

One of the drawbacks of the above-described arrangement, in which the structure includes a number of separate spans of elongate safety element around its periphery, is that personnel must detach themselves from one vertical span and undertake a horizontal traverse, perhaps unsecured, before attaching themselves to the next vertical span.

Another disadvantage of known vertical fall arrest devices is that they tend to be uni-directional with regard to their fall arrest capability. For example, where the fall arrest device relies on a cam locking action for gripping the cable, the device needs to be installed on the cable in the correct orientation for effective operation. If it is installed the wrong way up, the cam cannot grip the cable when the device is descending the cable. Hence, it is ineffective as a fall arrest aid.

To overcome this drawback, the device can be configured to prevent incorrect installation. However, this usually increases its complexity and, inevitably, its weight and cost.

Another drawback of unidirectional cam-locking devices is that they are not ideal for use by personnel working on the apex of a roof, or similar structures where the surface slopes in more than one direction. In such circumstances, a common safety cable may be provided which crosses the roof apex and spans both slopes either side of it. If a workman wishes to ascend one side and descend the other, he must re-orient his fall arrest device at the point where the roof slope changes direction. This is analogous to the situation described above in which intermediate horizontal traverses are executed between different vertical spans of safety cable.

The workman is at his most vulnerable at the change-over point and it would be preferable if such circumstances could be avoided.

Above all, it is inconvenient to the workman to have to detach and reattach a safety device every time a change in orientation occurs. Such inconvenience is likely to lead to the situation in which the workman takes risks by declining to re-attach his fall arrest equipment to the safety cable for brief periods, thereby adding to the fall hazard.

Cable-mounted fall arrest devices have been proposed which attempt to address this problem by using double cams. One cam is mounted to activate in a fall arrest situation when the device is travelling along the cable in a first direction, whilst the second cam is mounted in the opposite sense and activates in a fall arrest situation when the device is travelling in the opposite direction.

One drawback of these proposed double cam devices is that they are bulky and hence heavy to wear. Their bulk also means that they can only negotiate larger radius curves on the suspended cable, with the result that their applicability is limited. In addition, they can be inconvenient to handle during installation on the cable because the cams have to be manipulated into a position which allows passage of the cable into the mechanism.

It is therefore an object of the present invention to provide a versatile hands-free personnel safety device for reducing the risk of injury to personnel engaged in work in elevated or vulnerable positions, which is adapted to travel along a continuous span of elongate safety line regardless of the orientation of the safety line. It also an object of the present invention to provide a versatile personnel safety device having bi-directional fall arrest capability. It is a still further object of the present invention to provide a versatile personnel safety device which requires minimal manipulation on the part of the user to negotiate intermediate support brackets and/or changes in orientation of a safety line to which the device is attached in use.

The invention is a personnel safety device adapted to be installed in use on a fixed elongate support element in a manner which allows translational movement of the device along said elongate support element, said device comprising a body member having a bore for receiving said elongate support element, slipper means mounted on said body member said slipper means having a control surface oriented substantially parallel to the longitudinal axis of said bore, and connecting means connected at one end to said slipper means and being adapted at its other end for connection to a personnel safety harness, said slipper means being movable in response to sudden loading of the connecting means between a first position in which the control surface allows free passage of the elongate support element through the bore and a second position in which the control surface grips the elongate support element firmly relative to the body member, in which said slipper means maintains the control surface in its orientation substantially parallel to the longitudinal axis of said bore throughout movement of the slipper means between said first and second positions, and characterised in that the body member is provided with ramp surfaces engageable by the slipper means, said ramp surfaces being adapted to effect movement of the slipper means between its first and second positions.

When the device is subjected to rapid acceleration and/or sudden movements, for example in the event of a fall by a workman connected to the device through a lanyard, this is experienced initially by the connecting means which is connected to the slipper means. The slipper means moves in a direction to follow the sudden applied load, such movement occurring fractionally before the body member is able to move. As a result, the slipper means moves from its first position, in which the control surface allows free passage of the elongate support element through the bore of the body member, to its second position, in which the control surface grips the elongate support element firmly relative to the body member. The device thus locks on to the elongate support element and remains in position until such time as the tensile loading is intentionally removed.

If the workman is incapacitated as a result of the fall, he will remain suspended by his safety harness until he is rescued.

Because the slipper means moves in a manner which maintains the control surface in an orientation substantially parallel to the longitudinal axis of the bore of the body member, the device has bi-directional fall arrest capability.

Preferably, the slipper means is mounted in the bore, with the connecting means protruding through an aperture in the body member. In normal use, the slipper means lies in a neutral position at the base of the ramp means, the control surface allowing free passage of the elongate support element through the bore of the body member. However, in a fall arrest situation, the slipper means moves along the ramp means to an active position in which the control surface grips the elongate support element and holds the device fast relative thereto.

In its neutral condition, the slipper means may be urged into light contact with the elongate support element to assist in smooth passage of the device along the element. For example, compression springs may be used to urge the slipper means radially inwardly towards the centre of the bore. However, it is important to note that, whatever resilient means are used bring about this light contact with the elongate support element, the return force is easily overcome and the resilient means on their own are incapable of locking the device onto the elongate support element in a fall arrest situation.

The safety device is part of a fall arrest system which comprises end anchors and intermediate brackets for supporting the elongate element. The device is able to negotiate the intermediate brackets without user intervention, thereby minimising the risks associated with detachment of the line to transfer between adjacent spans of support element.

Preferably, the body member of the device has a slot extending along its length and radially outwardly from the bore to the exterior of said body member for allowing passage of the device past intermediate brackets for the elongate support element. Most preferably, the longitudinal slot is provided in the body member at a circumferential orientation relative to the slipper means other than 180°±50°. This means that, should the fall arrest device ever be deployed in a fall arrest situation, the elongate support element does not become compressed into the longitudinal slot by the control surface of the slipper means.

Alternatively, the body member may be tubular with no longitudinal slot. To enable this variant to traverse intermediate brackets supporting the elongate support element, these brackets are provided with an aperture dimensioned to accommodate the body member of the device and have a slot to allow passage of the connecting means past the support point.

The invention will now be described by way of example only with reference to the drawings, in which.

Figure 1:
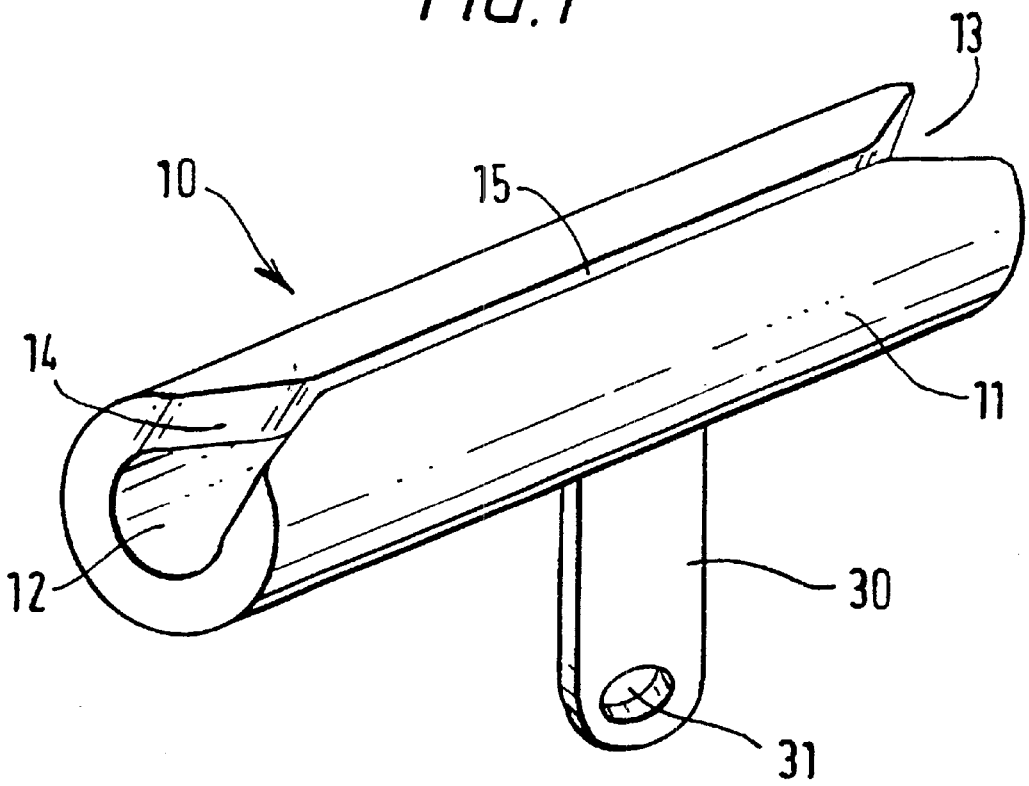
FIG. 1 is a perspective view of a personnel safety device in accordance with a preferred embodiment of the present invention.

Referring now to FIG. 1, a personnel safety device 10 in accordance with a preferred embodiment of the present invention comprises a body member 11 fashioned out of a suitable material such as stainless steel. The body member 11 has a central bore 12 dimensioned to receive an elongate support element such as a multi-stranded safety cable. Typically for a fall arrest system, the cable will have an external diameter of 8 mm and the bore 12 of the body member will have a diameter of 12 mm. Body member 11 may have special formations at both of its ends 13, 14 to assist in negotiating intermediate support brackets in substantially hands-free fashion, in a manner to be described in more detail below. A connecting member 30 protrudes from one side of the body member 11 and includes a connecting eye 31 adapted to receive a karabiner or similar device for attaching a personnel safety harness to the device 10 by means of a lanyard.

Figure 2:
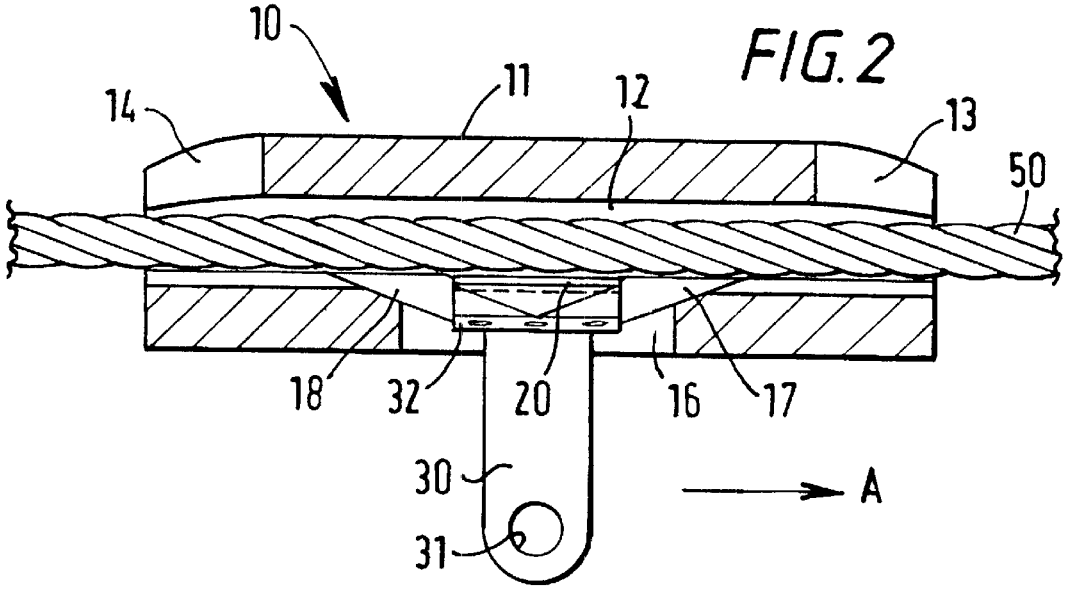
FIG. 2 is a side sectional view of the device of FIG. 1.
Figure 3:
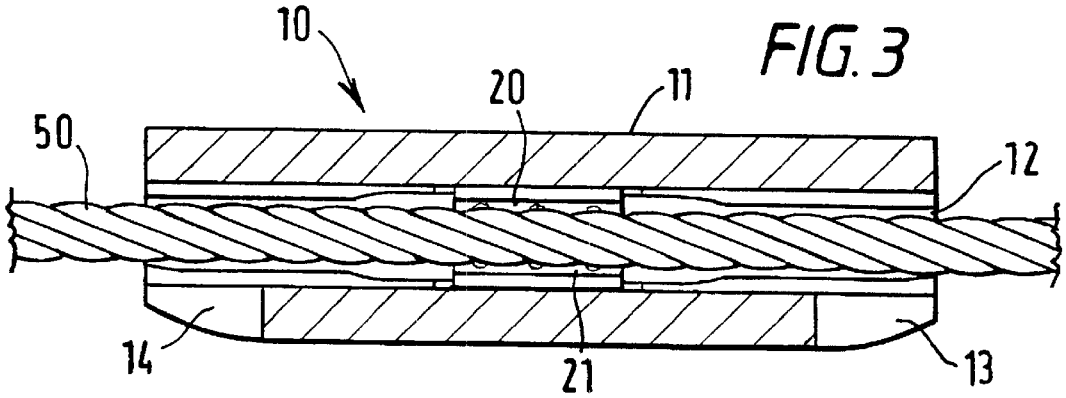
FIG. 3 is a sectional view from above of the device shown in FIG. 2.
Figure 4:
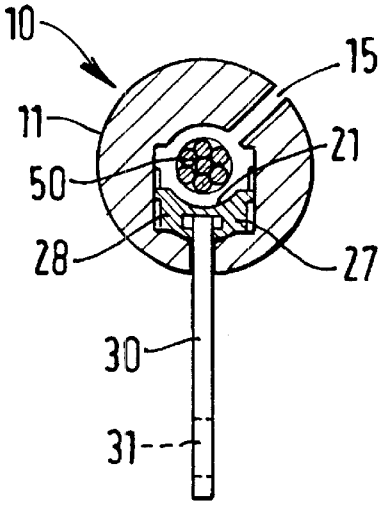
FIG. 4 is a sectional end elevation of the device depicted in FIGS. 2 and 3.

Turning now to FIGS. 2 to 4, the device 10 is shown installed on a safety cable 50. Cable 50 is attached at remote locations by end anchors to a fixed structure (not shown) and will be supported at intervals along its length by intermediate support brackets. As best seen in FIG. 4, body member 11 is provided with a longitudinal slot 15 which extends radially from the bore 12 to the exterior of the body member 11 for its entire length between ends 13, 14. The slot 15 is dimensioned to receive and pass a limb of an intermediate support bracket for the cable 50 so that the device 10 can pass along the entire cable length without hindrance. The limb may be in the form of a flat web lying in a plane parallel to the longitudinal axis of the cable 50, said web providing the connection between the cable-supporting part of the bracket and the fixing plate or similar means by which it is attached to a fixed structure. At the ends 13, 14 of the body member 11, the material of the body member 11 may be cut away to form a substantially V-shaped slot which assists in aligning the device with intermediate support brackets for ease of passage in a hands-free manner.

As best seen in FIGS. 2 and 4, the connecting member 30 passes through an aperture 16 in one side of the body member 11 of the device 10 and is attached to a slipper element 20. The attachment of the connecting member 30 to the slipper element 20 may be effected by any suitable means, such as a series of bolts passing through an upper flange 32 of the connecting member 30 and screwed into threaded holes (not shown) in the underside of the slipper element 20.

As best seen in FIG. 4, slipper element 20 has a control surface 21 which has a concavity that is complementary to the outer circumference of the cable 50.

In FIGS. 2 to 4, the slipper element 20 is shown seated in a neutral position near the mid-point of the body member 11. The slipper element 20 need not make any physical contact with the cable 50 in this condition, not even light contact.

Figure 5:
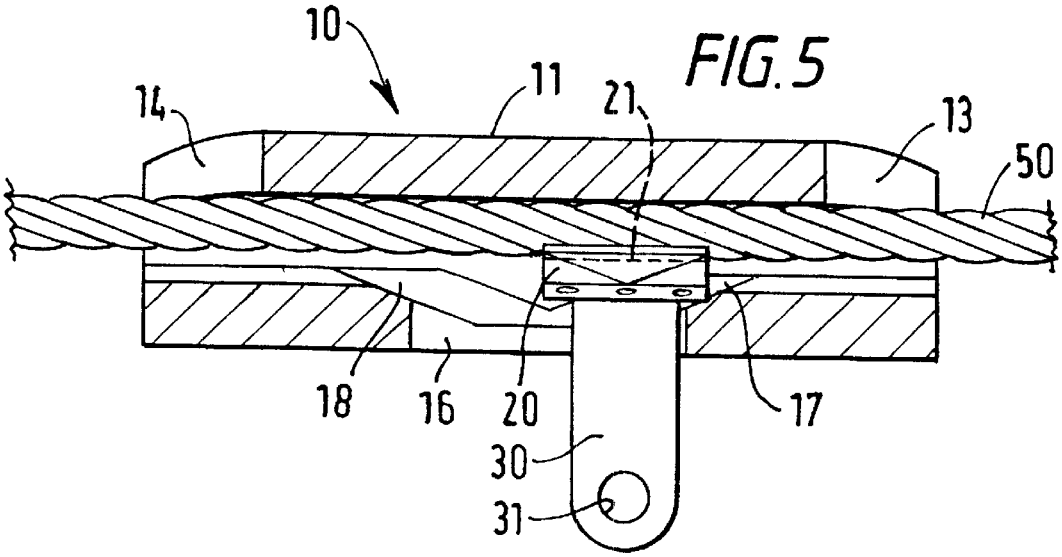
FIG. 5 is a view similar to FIG. 2 showing the device in a cable-gripping position.

The central portion of the body member 11 is provided with a pair of ramp surfaces 17, 18 which are adapted to be engaged by formations 27, 28 provided on the sides of the slipper element 20. If the device 10 is then subjected to rapid acceleration and/or sudden movement in a direction having a component along the longitudinal axis of the cable 50, for example in the event of a fall by a workman connected to the connecting eye 31 through a lanyard, the connecting member 30 transmits this sudden movement to the slipper element 20. Slipper element 20 is thus caused to move in a direction that follows the sudden applied load (here indicated by arrow A), along ramp surface 17, to the position shown in FIGS. 4 to 6.

Figure 6:
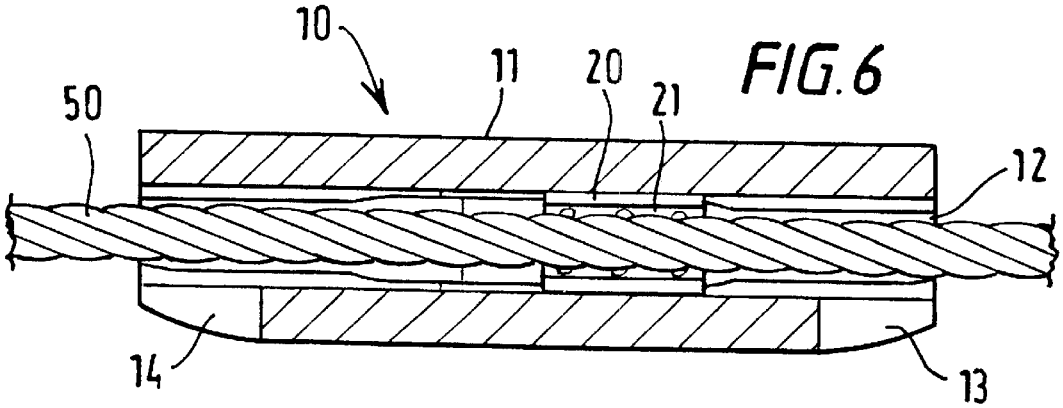
FIG. 6 is a sectional view from above of the device in its cable-gripping position as shown in FIG. 5.
Figure 7:
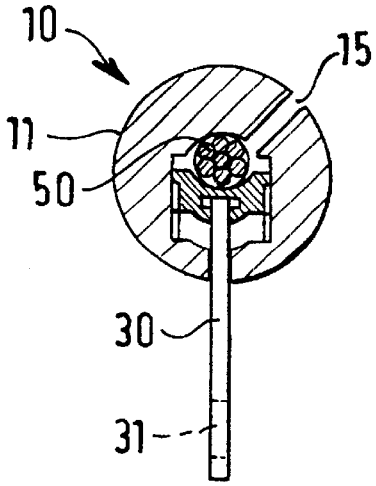
FIG. 7 is a sectional end view of the device in its cable-gripping position as shown in FIGS. 5 and 6.

As best seen in FIG. 6, the control surface 21 of the slipper element 20 is forced into firm engagement with the exterior of the cable 50 which becomes gripped between the slipper element 20 and the bore 12 of the body member 11. The device 10 is held fast on the cable 50 and will remain in position until removal of the tensile load which caused activation of the slipper element 20 to its cable-gripping state.

It will be readily apparent to persons skilled in the art that sudden movement in the sense opposite the direction indicated by arrow A would result in the slipper element 20 being moved up ramp surface 18 instead. Nevertheless, an equivalent cable-gripping state is achieved. Thus, the device 10 is truly bi-directional in its fall arrest capability. Moreover, the cable-gripping capability is effective regardless of the inclination of the cable. All that is required to achieve cable gripping is a sudden movement in a direction having a component along the longitudinal axis of the cable 50, such that the inertia of the body member 11 relative to the slipper element 20 causes the slipper element 20 to move along one of the ramp surfaces 17, 18.

Using the device of the present invention, it is therefore possible for the installer of a height safety system to use a single elongate support element in substantially horizontal or substantially vertical orientations, and orientations in between, in the same installation and without the need for separate spans for each change in orientation.

Although the invention has been particularly described above with reference to specific embodiments, it will be understood by persons skilled in the art that these are merely illustrative and that variations are possible without departing from the scope of the claims which follow.

What is claimed is:

1. A personnel safety device (10) adapted to be installed in use on a fixed elongate support element (50) in a manner which allows translational movement of the device (10) along said elongate support element (50), said device (10) comprising a body member (11) having a bore (12) for receiving said elongate support element (50), a slipper (20) mounted on said body member (11), said slipper (20) having a control surface (21) oriented substantially parallel to a longitudinal axis of said bore (12), and connecting means (30) connected at one end to said slipper (20) and being adapted at the other end for connection to a personnel safety harness, said slipper (20) being movable in response to sudden loading of the connecting means (30) between a first position in which the control surface (21) allows free passage of the elongate support element (50) through the bore (12) and a second position in which the control surface (21) grips the elongate support element (50) firmly relative to the body member (11), in which said slipper (20) maintains the control surface (21) in the orientation substantially parallel to the longitudinal axis of said bore (12) throughout movement of the slipper (20) between said first and second positions and characterized in that the body member is provided with ramp surfaces (17, 18) engageable by the slipper (20), said ramp surfaces (17, 18) being adapted to effect movement of the slipper (20) between the first and second positions.

2. The personnel safety device (10) as claimed in claim 1 wherein the slipper (20) is mounted in the bore (12) and the connecting means (30) protrudes through an aperture (16) in the body member (11).

3. The personnel safety device (10) as claimed in claim 1 wherein the body member (11) has a slot (15) extending along its length and radially outwardly from the bore (12) to the exterior of the body member (11).

4. The personnel safety device (10) as claimed in claim 3 wherein the longitudinal slot (15) is provided in the body member (11) at a circumferential orientation relative to the slipper (20) other than 180°±5°.

5. The personnel safety device (10) as claimed in claim 1 wherein the body member (11) is tubular and includes first and second spaced apart opposite axial ends (13, 14) and a longitudinal slot (15) extending a distance between but not up to said first and second axial ends (13, 14).

6. A height safety system incorporating a fixed elongate support element (50) and at least one personnel safety device (10) installed on the fixed elongate support element (50) in a manner which allows translational movement of the device (10) along said elongate support element (50), said device (10) comprising a body member (11) having a bore (12) for receiving said elongate support element (50), a slipper (20) mounted on said body member (11), said slipper (20) having a control surface (21) oriented substantially parallel to a longitudinal axis of said bore (12), and connecting means (30) connected at one end to said slipper (20) and being adapted at the other end for connection to a personnel safety harness, said slipper (20) being movable in response to sudden loading of the connecting means (30) between a first position in which the control surface (21) allows free passage of the elongate support element (50) through the bore (12) and a second position in which the control (21) grips the elongate support element (50) firmly relative to the body member (11), in which said slipper (20) maintains the control surface in the orientation substantially parallel to the longitudinal axis of said bore (12) throughout movement of the slipper (20) between said first and second position and characterized in that the body member (11) is provided with ramp surfaces (17, 18) engageable by the slipper (20), said ramp surface (17, 18) being adapted to effect movement of the slipper (20) between the first and second positions.

7. A personnel safety device for location on a fixed elongate support element, the device surrounding the elongate support element and being movable relative to the elongate support element when located on the elongate support element, the device comprising:

a body member extending along a longitudinal axis and defining a bore for receiving the elongate support element, a slipper mounted on the body member, the slipper having a control surface located parallel to the longitudinal axis, and a connecting means connected at one end to the slipper and being adapted at the other end for connection to a personnel safety harness, the slipper being movable, in response to a sudden force exceeding a predetermined force applied to the connecting means, between a first position in which the control surface does not engage the elongate support element and the elongate support element moves freely through the bore and a second position in which the control surface grips the elongate support element firmly against movement relative to the body member, the control surface remaining in the location parallel to the longitudinal axis throughout movement of the slipper between the first and second positions, the body member including ramp surfaces which are surfaces inclined relative to the longitudinal axis, the slipper sliding on the ramp surfaces between the first and second positions.

* * * * *